US006408746B1

(12) United States Patent
Weschenfelder

(10) Patent No.: US 6,408,746 B1
(45) Date of Patent: Jun. 25, 2002

(54) PRINTING UNIT

(75) Inventor: Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/744,234

(22) PCT Filed: Jul. 23, 1999

(86) PCT No.: PCT/DE99/02261

§ 371 (c)(1),
(2), (4) Date: Jan. 24, 2001

(87) PCT Pub. No.: WO00/06382

PCT Pub. Date: Feb. 10, 2000

(30) Foreign Application Priority Data

Jul. 24, 1998 (DE) ..... 198 33 470

(51) Int. Cl.[7] ..... B41F 7/02; B41F 7/10

(52) U.S. Cl. ..... 101/142; 101/136; 101/177; 101/220; 101/221

(58) Field of Search ..... 101/137, 138, 101/139, 140, 141, 142, 143, 144, 145, 177, 179, 180, 181, 182, 183, 184, 185, 217, 218, 219, 220, 221, 136

(56) References Cited

U.S. PATENT DOCUMENTS 3,983,811 A * 10/1976 Fuchs et al. ..... 100/162 B
4,281,595 A * 8/1981 Fujishiro ..... 101/177
4,394,835 A 7/1983 Gertsch et al. ..... 101/177

FOREIGN PATENT DOCUMENTS

| | | | |
|---|---|---|---|
| DE | 1924455 | 7/1970 | |
| DE | 2024482 | 12/1971 | |
| DE | 2165185 | 11/1972 | |
| DE | 2409219 A1 * | 9/1975 | ..... B41F/7/14 |
| DE | GM- 7322211 | 1/1977 | |
| DE | 29 51 249 | 7/1980 | |
| DE | 3446619 A1 | 6/1986 | |
| DE | 43 03 904 A1 | 8/1994 | |
| DE | 43 03 904 C2 | 11/1997 | |
| EP | 0 638 419 A | 2/1995 | |

OTHER PUBLICATIONS

Oscar Frei: Rollenoffset, Techniken Systeme Maschinen, Systems Presses, Polygraph, publ., 1979.

Gerd Finkbeiner: Investitionsentscheidungen im Zeitungsdruck sollten sich immer an der geplanten Auslastung orientieren, Deutscher Drucker, publ. 1993.

* cited by examiner

*Primary Examiner*—Daniel J. Colilla
(74) *Attorney, Agent, or Firm*—Jones, Tullar & Cooper, PC

(57) ABSTRACT

A printing unit of an offset printing press utilizes a plurality of forme cylinders, transfer cylinders and at least two counter-pressure cylinders. In one mode of production all of the transfer cylinders engage one of the counter-pressure cylinders. In another mode of production two of the transfer cylinders cooperate with one of the counter-pressure cylinders and at least another one of the transfer cylinders cooperate with the other counter-pressure cylinder.

13 Claims, 5 Drawing Sheets

PRINTING UNIT

FIELD OF THE INVENTION

The present invention relates to a printing unit of an offset printing press with at least four forme cylinders, at least four transfer cylinders and at least one counter-pressure cylinder. In a first type of production at least four transfer cylinders can be placed against a common counter-pressure cylinder.

DESCRIPTION OF THE PRIOR ART

A rotary offset printing press in a satellite construction is known from DE-GM 73 22 211. Here, a web of material, for example, is printed by a ten cylinder printing unit and a nine cylinder printing unit. It is not disclosed to let the ten cylinder printing unit produce as a nine cylinder printing unit.

The reference manual "Rollenoffset, Technik, Systeme, Maschinen" Cylinder Offset, Technology, Systems, Presses, Oscar Frei Polygraph, publ., 1979, discloses, on page 10, a combination of two five cylinder satellite printing units.

DE 43 03 904 A1 and DE 19 24 455 A1 both disclose printing units whose cylinders are arranged in the form of a letter "W".

EP 0 638 419 A1 describes a printing press, wherein printing units are fastened on a support frame. Individual modular units, such as ink units or cylinder groups, for example, can be displaced in the direction of the cylinder axes.

DE 34 46 619 A1 shows a printing press, in which two movable groups of presses are described. However, these groups are only provided with four plate cylinders, to each of which an ink and dampening unit is assigned. Rubber blanket cylinders and counter-pressure cylinders are installed in a stationary press group.

SUMMARY OF THE INVENTION

The present invention is based on the object of creating a printing unit.

This object is attained in accordance with the invention by [means of the characteristics of claims 1.] providing the printing unit of an offset printing press with at least four forme cylinders, at least four transfer cylinders and at least one counter-pressure cylinder. In a first type of production, at least four transfer cylinders can be place against a common counter-pressure cylinder. A second counter-pressure cylinder is also provided and in a second type of production at least two of the transfer cylinders work with the first counter-pressure cylinder while at least one of the other two transfer cylinders works with the second counter-pressure cylinder.

It is possible, in an advantageous manner, to perform a plurality of types of production by use of the printing units of the invention. For example, two five cylinder printing units can produce either individually or can produce together as a ten cylinder printing unit. In particular, two five cylinder printing units, each with different cylinder arrangements, can be used as a nine cylinder printing unit. The modular construction of the present invention permits the identical arrangement of the printing units; the modular construction kit consists of only two basic elements.

Here, the modular units can be combined in two ways. In a first way, one modular unit operates as an individual printing unit independently of a second one, while in a second way, two modular units are combined into a common printing unit. A placement reversed by 180°, with a shifting of the drive mechanism side and the operating side, is also possible. Thus, the drive mechanisms for the printing units are not arranged on a single side of the printing press. Instead, the drive mechanisms remain fixedly assigned to a lateral frame.

The ink systems also remain the same. A reversal of the direction of rotation is not necessary, since the combination of the modular units and their flexible assignment make possible 4/4, 4/2, 2/4 and 2/2 production requirements. Because of the possibility of movable printing units, operation from the inside is possible. This operation from inside is advantageous with "W" printing units in particular, because no release devices are therefore necessary.

By means of displaceable printing units, it is also possible to produce, by means of spaced-apart five cylinder printing units, as well as with two coupled five cylinder printing units, wherein respectively different types of production are possible.

If only a 4/2 or 2/4 production is desired, no "empty frames" of a satellite printing unit are necessary, since it is possible to arrange a singly arranged five cylinder printing unit to operate together with a four-color-producing satellite printing unit (ten or nine cylinder printing unit).

The placement of work platforms which can be raised and lowered in the intermediate frames and at the modular cylinder units makes the easy operation of the printing units possible.

BRIEF DESCRIPTION OF THE DRAWINGS

Preferred embodiments of the present invention are represented in the drawings and will be described in greater detail in what follows.

Shown are in:

FIGS. 1 and 2, a schematic representation of the V- and W- printing units, FIG. 3, a schematic representation of a lateral view of printing units in a first type of production, FIG. 4, the schematic representation of a lateral view of printing units in a second type of production, and in.

DESCRIPTION OF THE PREFERRED EMBODIMENTS

Figure 3:
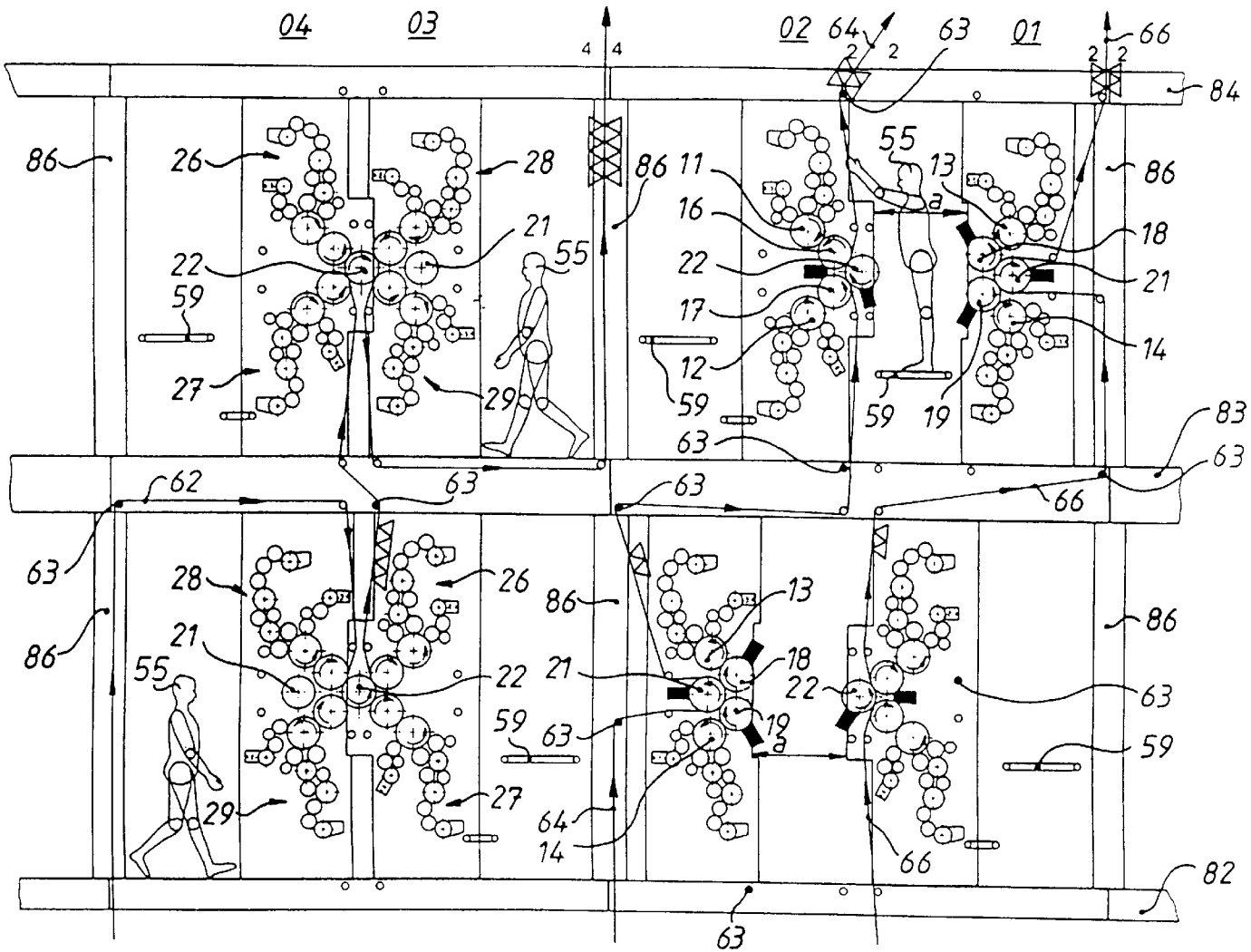
Figure 4:
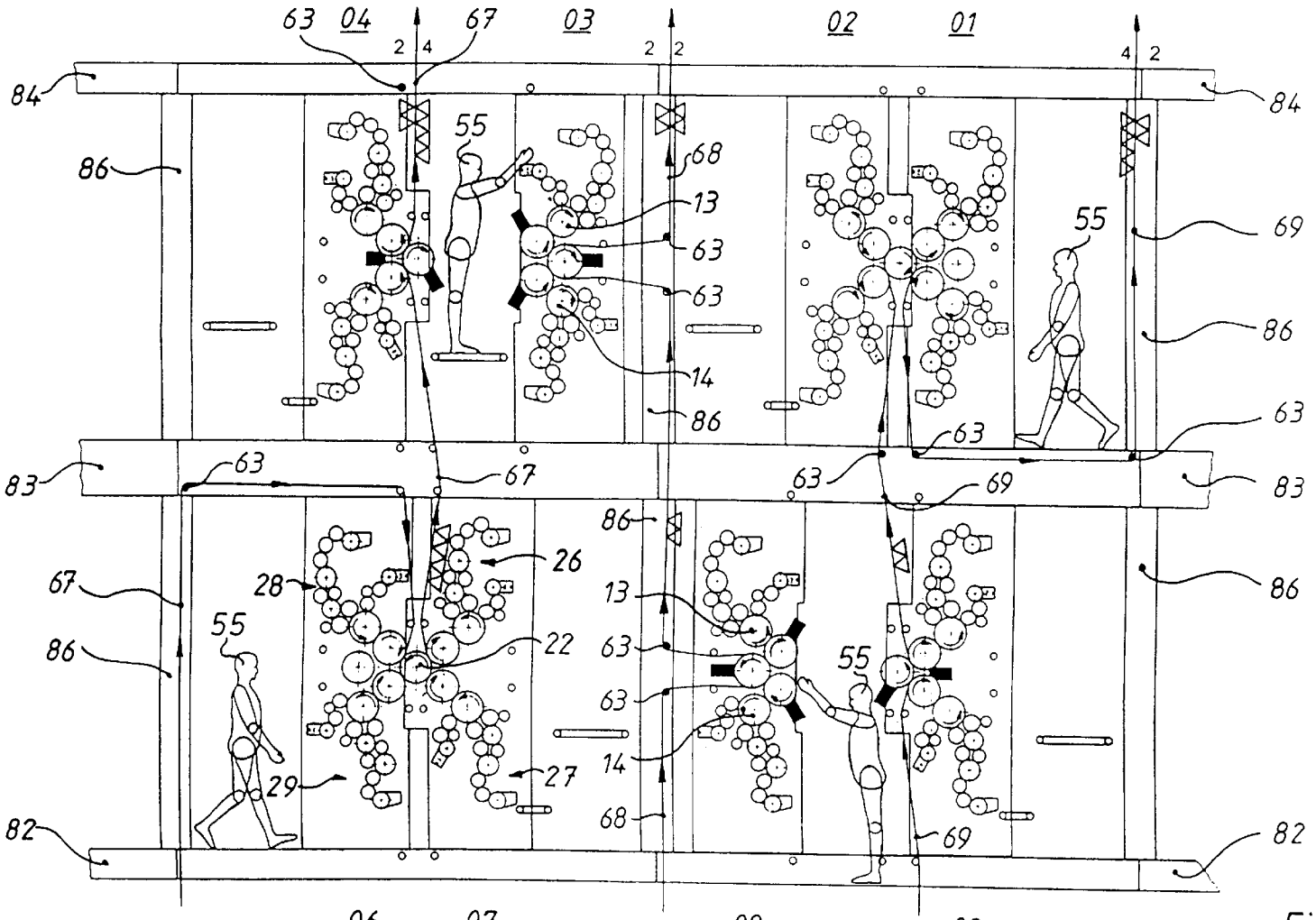

An offset rotary printing press, or a section of an offset rotary printing press has, for example, eight printing units 01 to 04, 06 to 09 in modular construction, as seen in FIGS. 3 and 4. Each one of these printing units 01 to 04, 06 to 09 is designed as a so-called five cylinder printing unit and essentially has two forme cylinders 11 to 14, for example plate cylinders, two transfer cylinders 16 to 19, for example rubber blanket cylinders, and one counter-pressure cylinder 21, 22 or satellite cylinder. Journals of these forme or plate cylinders 11 to 14, transfer or blanket cylinders 16 to 19, and counter-pressure cylinders 21, 22 are seated on each side of the offset rotary printing press in respectively one lateral frame 23, 24. In the present preferred embodiment, the journals of the transfer cylinders 16 to 19 are pivotably seated in eccentric bushings or by means of three-ring bearing technology, so that the transfer cylinders 16 to 19 can be placed against or removed from the associated counter-pressure cylinders 21, 22 and/or forme cylinders 11 to 14.

It is also possible to place the counter-pressure cylinders 21, 22 against the associated transfer cylinders 16 to 19 by means of eccentric bushings, three-ring bearings or linear guidance, for example.

In the present preferred embodiment, each cylinder 11 to 14, 16 to 19, 21, 22 is provided with its own rpm-controlled and/or its own position-controlled drive motor.

It is also possible to assign a drive motor to each pair of forme and transfer cylinders 11, 16; 12, 17; 13, 18; or 14, 19, and to connect this pair in an interlocking manner. In this case, the counter-pressure cylinder 21, 22 also has its own drive motor, or can be coupled to one of these pairs of forme and transfer cylinders 11, 16; 12, 17; 13, 18; or 14, 19.

It is also possible to assign only one drive motor to each printing unit 01 to 04, 06 to 09.

Figure 5:
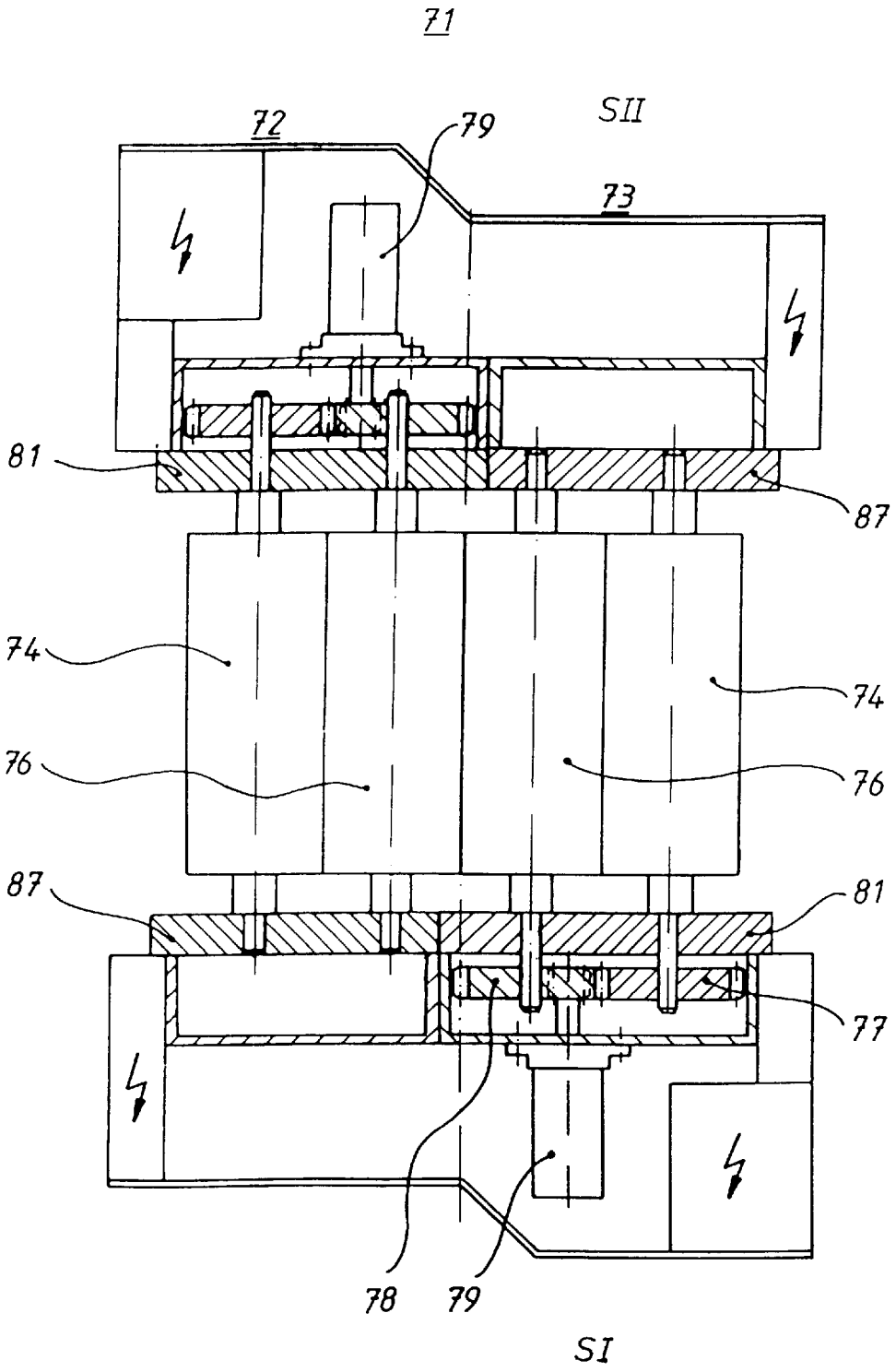
FIG. 5, a schematic top plan view on a bridge printing unit in modular construction.

In every case, the drive motors are each fixedly arranged in a lateral frame 23, 24, independently of the position and location of placement of the printing units 01 to 04, 06 to 09, so that with the printing units 06 to 09, which units 08 and 09 have been placed pivoted by 180° around a vertical line with respect to units 06 and 07, the drive motors for the printing units 06 to 09, which are placed pivoted in respect to each other, are arranged on opposite sides SI, SII, as seen in FIG. 5, of the printing press. The drive motors of a printing unit 01 to 04, 06 to 09 can also be arranged distributed over both lateral frames 23, 24. For example, the drive motors for the counter-pressure cylinders 21, 22 and the forme cylinders 11 to 14 are arranged on the first lateral frame 23, 24, and the drive motors for the transfer cylinders 16 to 19 on the second lateral frame 23, 24. Here, too, the assignment of the drive motors to the respective lateral frame 23, 24, in case of a pivoted placement of the printing units 06 to 09, remains within the printing press, or within a section of the printing press.

This assignment of the drive motors to a lateral frame in case of a pivoted placement of the printing units 06 to 09 within the printing press, or a section of the printing press, is also possible with other printing units in modular construction. Thus, a bridge printing unit 71 as seen in FIG. 5, can also be formed, for example, from two modular units 72, 73, each with a pair of forme and transfer cylinders 74, 76, wherein one modular unit 72 is arranged pivoted around a vertical line by 180° in respect to the other modular unit 73. Respectively, one pair of forme and transfer cylinders 74, 76 is seated in a pair of lateral frames 81, 87. In this case, one pair of the forme and transfer cylinders 74, 76 is interlockingly connected via gear wheels 77, 78 for being driven of a drive motor 79. During printing operations, the two pairs are not interlockingly coupled with each other. This drive motor 79 is fixedly assigned to a lateral frame 81.

With at least two printing units arranged inside a printing press, at least their cylinders and their lateral frames, as well as drive means, for example gears, gear wheels, drive motor assigned to the respective lateral frame or the respective cylinder, are arranged pivoted around a vertical line.

Respectively, one ink unit 26 to 29 and one dampening unit 31 to 34 are assigned to each forme cylinder 11 to 14, wherein the dampening unit 31 to 34 is arranged upstream of the ink unit 26 to 29 in respect to the production direction of the forme cylinder 11 to 14.

In connection with a first type of printing unit 02, 04, 07, 09, a straight first line 41, or 42, determined by an axis of rotation 37 of the counter-pressure cylinder 22 and an axis of rotation 38, 39 of an associated transfer cylinder 16, 17, and a straight second line 46, 47 determined by an axis of rotation 38, 39 of the transfer cylinder 16, 17 and an axis of rotation 43, 44 of the forme cylinder 11, 12, enclose an opening angle $\alpha$ in a range between 150° to 210°, preferably 170° to 190°. The straight first line 41 determined by the axis of rotation 38 of the first transfer cylinder 16 and the axis of rotation 37 of the counter-pressure cylinder 22 encloses an opening angle $\beta$ in the range between 60° to 120°, preferably 70° to 90°, with the corresponding straight first line 42 determined by the axis of rotation 39 of the second transfer cylinder 17 and the axis of rotation 37 of the counter-pressure cylinder 22. The cylinders 11, 12, 16, 17, 22 of the printing units 02, 04, 07, 09 of the first type are arranged in a so-called "V" arrangement, all as seen most clearly in FIG. 2 at the left thereof.

A washing device 36, for example, can be selectively placed against the transfer cylinders 16 to 19 and/or the counter-pressure cylinders 21, 22.

The tight cylinder arrangement of the V-printing unit 02, 04, 07, 09 makes it possible to simultaneously clean two cylinders with one washing device 36.

Figure 1:
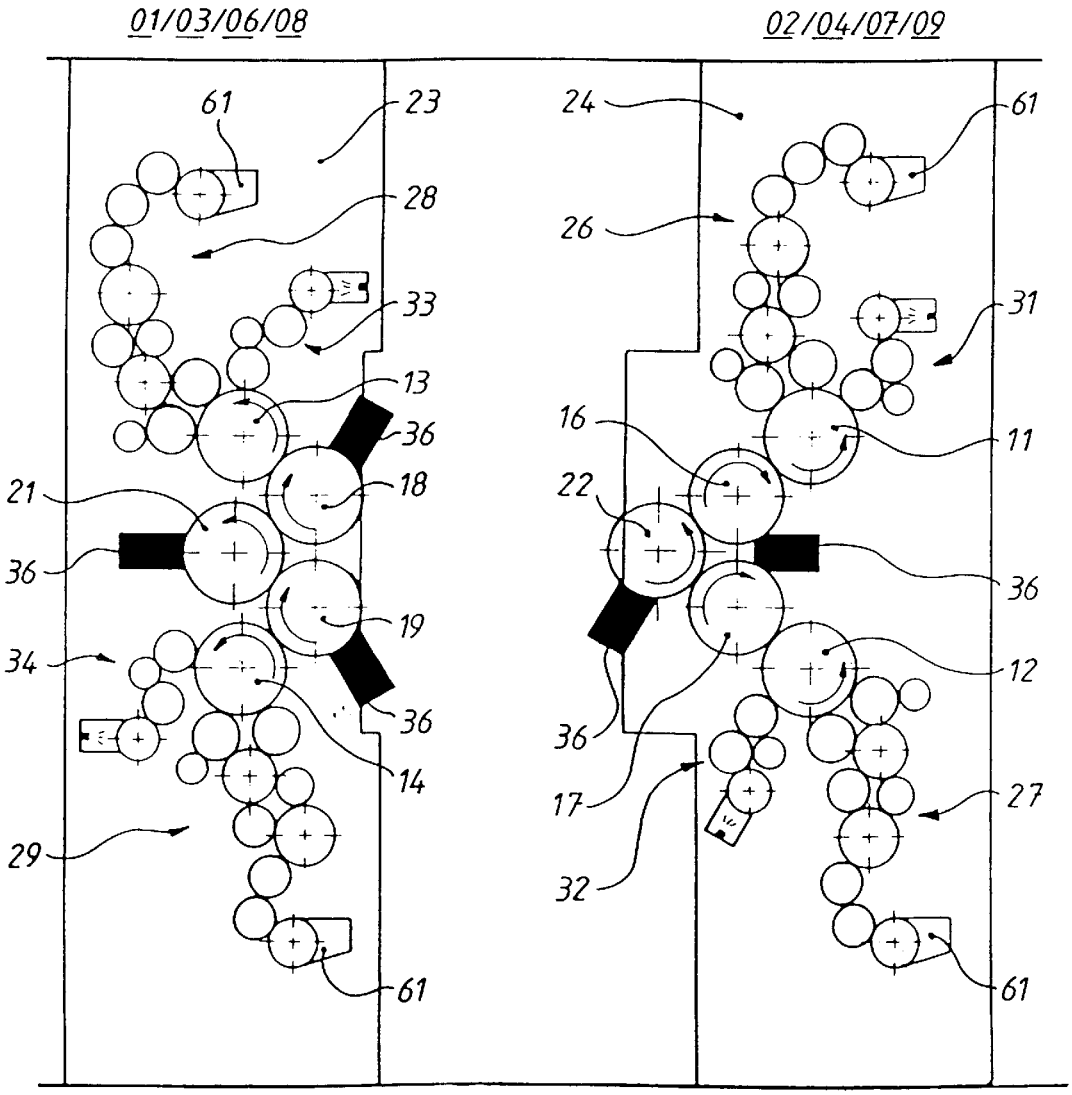
Figure 2:
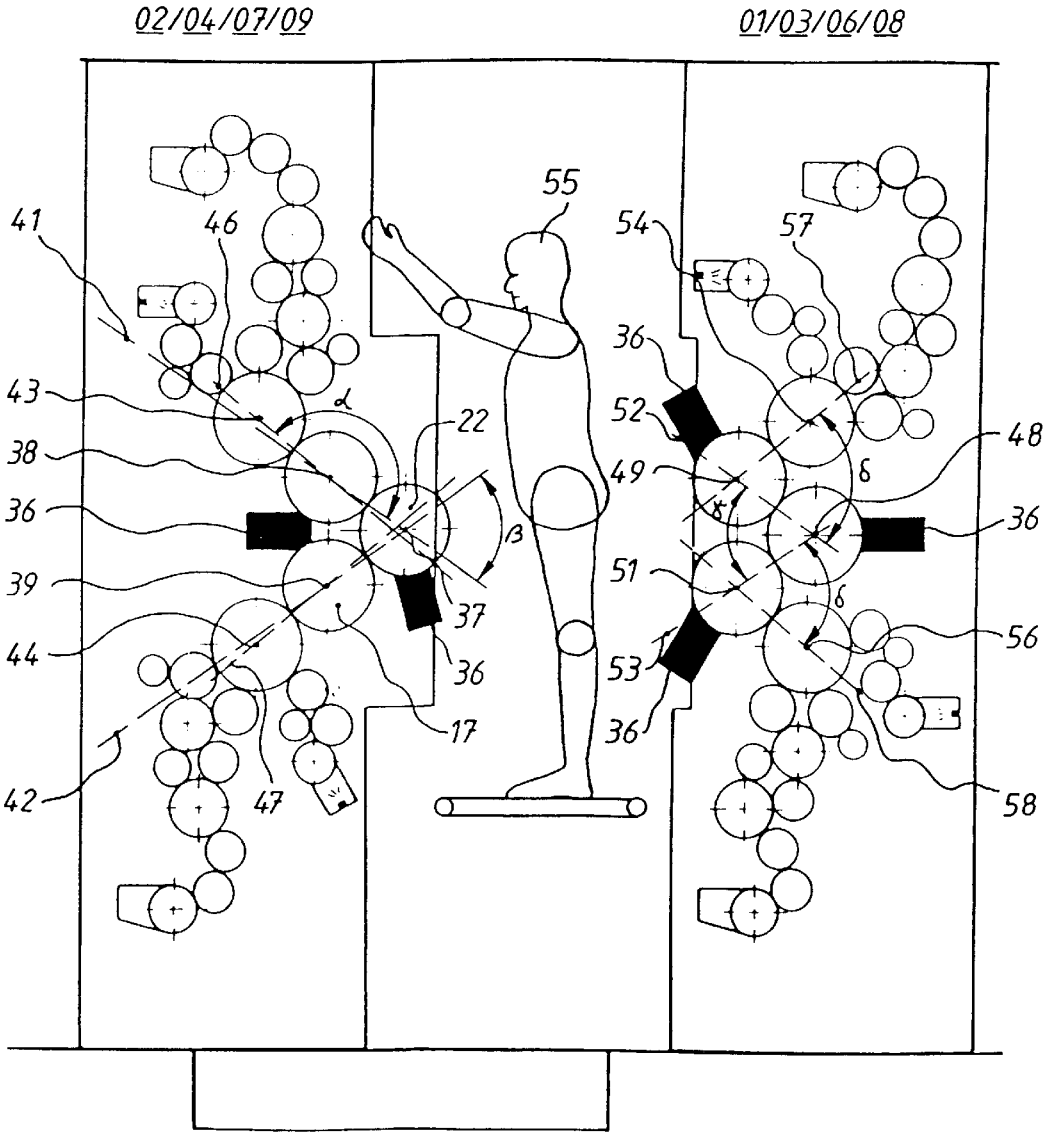

In connection with a second type of printing unit 01, 03, 06, 08, as seen at the right side of FIG. 2, a first straight line 52, 53 determined by an axis of rotation 48 of the counter-pressure cylinder 21 and an axis of rotation 49, 51 of an associated transfer cylinder 18, 19, and a second straight line 57, 58, determined by an axis of rotation 49, 51 of the transfer cylinder 18, 19 and an axis of rotation 54, 56 of the forme cylinder 13, 14, enclose an opening angle $\delta$ in a range between 90° to 120°, preferably 85° to 100°. The first straight line 52 determined by the axis of rotation 49 of the first transfer cylinder 18 and the axis of rotation 48 of the counter-pressure cylinder 21 encloses an opening angle $\gamma$, in the range between 60° to 120°, preferably 60° to 90°, with a straight line 53 determined by the axis of rotation 51 of the second transfer cylinder 19 and the axis of rotation 48 of the counter-pressure cylinder 21. The cylinders 13, 14, 18, 19, 21 of the printing units 01, 03, 06, 08 of the second type are arranged in a so-called "W" arrangement again, all as seen at the right side of FIG. 2.

In the present preferred embodiment, respectively one printing unit 02, 04, 07, 09, in a "V" arrangement, and one printing unit 01, 03, 06, 08, in a "W" arrangement, are arranged opposite each other as shown in FIGS. 1–4. In this case, the axes of rotation 37, 48 of the counter-pressure cylinders 21, 22 are located on the same side in relation to a straight line determined by the axes of rotation 38, 39, 49, 51 of the transfer cylinders 18, 19, 16, 17

With the printing units 01 to 04 of the upper level, all counter-pressure cylinders 21, 22 are located to the right of the associated transfer cylinders 16, 17, 18, 19. With the printing units 06 to 09 of the lower level all counter-pressure cylinders 21, 22 are located to the left of the associated transfer cylinders 16, 17, 18, 19. This is shown most clearly in FIG. 3.

With the "W" printing units 01, 03, 06, 08, the counter-pressure cylinders 21 are located on the outside, with the "V" printing units 02, 04, 07, 09 the counter-pressure cylinders 22 are located on the inside. With the printing press in accordance with the preferred embodiment, respectively one printing unit 01, 03, 06, 08 in a "W" arrangement and one printing unit 02, 04, 07, 09 in a "V" arrangement are arranged on top of each other.

The respective cooperatively positioned printing units 01, 02, or 03, 04, or 06, 07, or 08, 09 can each be operated independently of each other as five cylinder printing units located opposite each other, i.e. in a first mode of operation, each two printing units 01, 02, or 03, 04, or 06, 07, or 08, 09 located opposite each other functionally constitute a ten cylinder satellite printing unit, as seen at the right in FIG. 3.

During this first operational state, the transfer cylinders 16, 17, or 18, 19 operate together with the respective counter-pressure cylinders 22 or 21 of the "V" printing unit 02, 04, 07, 09 and "W" printing unit 01, 03, 06, 08. In a second mode of operation, two five cylinder printing units functionally act as a nine cylinder satellite printing unit, as seen at the left side of FIG. 3. To this end, the transfer cylinders 16, 17, 18, 19 of a "V" printing unit 04, 07 and a "W" printing unit 03, 06 can be placed against or away from the counter-pressure cylinder 22 of the "V" printing unit 04, 07. The counter-pressure cylinder 21 of the "W" printing unit does not take part in the printing process.

In the present preferred embodiment, respectively one "V" printing unit 02, 04, 07, 09 and a "W" printing unit 01, 03, 06, 08 can be moved in relation to each other, thus providing a distance "a" between the "V" printing unit 02, 04, 07, 09 and the "W" printing unit 01, 03, 06, 08, which distance "a" can be changed. To this end, the "V" printing unit 02, 04, 07, 09, for example, is arranged stationary, and the "W" printing unit 01, 03, 06, 08 can be horizontally displaced, again as seen at the right in FIG. 3.

Two associated "V" and "W" printing units 01, 02, or 03, 04, or 08, 09 are at a distance "a" from each other particularly for being operated and serviced by an operator, so that the resulting space between the two printing units 01, 02, or 03, 04, or 08, 09 becomes accessible. A work platform 59 is selectively arranged in this space. This work platform 59 can preferably be raised and lowered.

The operation and servicing of the ink units 26 to 29 takes place from the same side in the case of two associated printing units 01, 02, or 03, 04, or 06, 07 or 08, 09. Therefore, the ink ducts 61, for example, of the ink units 26 to 29 of both printing units 01, 02, or 03, 04, or 06, 07 are oriented to one side, i.e. on the upper level the ink ducts 61 are oriented pointing toward the left, and on the lower level they are oriented pointing toward the right, as shown in both FIGS. 3 and 4.

The advantage here is that all ink ducts can be designed in the same way.

In a first mode of production which is depicted in FIG. 3, the left printing units 03, 04, 06, 07 of the upper and lower levels are brought together and are coupled with each other. Thus, two nine cylinder printing units, stacked on top of each other, are formed. With each one of these two nine cylinder printing units the transfer cylinders 16 to 19 of the "V" and "W" printing unit 03, 04, or 06, 07 have been placed against the counter-pressure cylinder 22 of the adjacent "V" printing unit 04 or 07.

A web of material 62 is conducted on the counter-pressure cylinder 22 of the lower left "V" printing unit 07 by means of guide rollers 63 between the two stacked nine cylinder printing units from above between the two upper ink units 26, 28 of the "V" and the "W" printing units 07, 06. This web of material 62 is looped around the counter-pressure cylinder 22 and is conducted upward between the two upper ink units 26, 28 of the lower "V" and the "W" printing units 07, 06 and then out of the lower nine cylinder printing unit diagonally upward onto the counter-pressure cylinder 22 of the upper "V" printing unit 04.

In the upper nine cylinder printing unit, the web of material 62 also is looped around the counter-pressure cylinder 22 of the upper "V" printing unit 04 and is conducted downward out of the upper nine cylinder printing unit between the two lower ink ducts 27, 29 of the upper "V" and "W" printing unit 04, 03.

The web of material 62 can also be introduced first at the top and then on the bottom A first side of the web of material 62 is printed in four colors in the lower nine cylinder printing unit, and a second side of the web of material 62 is printed in four colors in the upper nine cylinder printing unit.

In accordance with a second mode of production, as seen in the right side of FIG. 3, the respectively two right printing units 01, 02, or 08, 09, of the upper and lower levels are spaced apart from each other and are therefore not coupled.

Here, a web of material 64 coming from below is fed from the outside between the lower forme cylinder 14 and the counter-pressure cylinder 21 to the counter-pressure cylinder 21 of the lower "W" printing unit 08. This web of material 64 is looped around the counter-pressure cylinder 21 over approximately 180° and is moved out of the "W" printing unit 08 toward the exterior between the upper forme cylinder 13 and the counter-pressure cylinder 21. This web of material 64 is then fed, via guide rollers 63 between the upper right "V" and "W" printing units 01, 02, to the counter-pressure cylinder 22 of the upper "V" printing unit 02, where web 64 is looped around the counter-pressure cylinder 22 over approximately 80° and is then conducted out of the upper "V" printing unit 02 between the upper right "V" and "W" printing units 02, 01.

A first side of the web of material 64 is printed in two colors in the lower "W" printing unit 08, and a second side of the web of material 64 is printed in two colors in the per "V" printing unit 02.

A further web of material 66 coming from below is fed via guide rollers 63 between the lower right "V" and "W" printing units 09, 08, to the counter-pressure cylinder 22 of the lower "V" printing unit 09. Web 66 is looped around this counter-pressure cylinder 22 over approximately 80° and is removed from the lower "V" printing unit 9 between the lower right "V" and "W" printing units 09, 08.

This web of material 66 is then fed between the lower forme cylinder 14 and counter-pressure cylinder 21 of the upper "W" unit 01 to the counter-pressure cylinder 21 of the upper "W" printing unit 01. The web of material 66 is looped around the counter-pressure cylinder 21 over approximately 180° and is moved out of the "W" printing unit 01 toward the exterior between the upper forme cylinder 13 and the counter-pressure cylinder 21.

A first side of the web of material 66 is printed in two colors in the lower "V" printing unit 09, and a second side of the web of material 66 is printed in two colors in the upper "W" printing unit 01.

In a third mode of production, which is shown in ]FIG. 4, the two left printing units 03, 04 of the upper level are spaced apart from each other and therefore are not coupled, and the two left printing units 06, 07 of the lower level are coupled to form a nine cylinder printing unit. The two right printing units 01, 02 of the upper level are coupled to form a nine cylinder printing unit, and the two right printing units 08, 09 of the lower level are spaced apart from each other.

A web of material 67 is conducted, by means of guide rollers 63 between the upper and lower levels, from the top between the two ink units 26, 28 of the "V" and "W" printing units 07, 08 on the counter-pressure cylinder 22 of the lower "V" printing unit 07. This web of material 67 is looped around the counter-pressure cylinder 22 of the "V" printing unit 07 and is conducted between the two upper ink units 26, 28 of the lower "V" and "W" printing units 07, 06 out of the lower nine cylinder printing unit diagonally upward over guide rollers 63 between the upper left "V" and "W" printing units 04, 03 on the counter-pressure cylinder 22 of the upper "V" printing unit 04.

This web of material 67 is looped around this counter-pressure cylinder 22 over approximately 80° and is moved out of the upper "V" printing unit 04 inside between the upper left "V" and "W" printing cylinders 04, 03.

A first side of the web of material 67 is printed in four colors in the lower nine cylinder printing unit, and a second side of the web of material 67 is printed in two colors in the upper "V" printing unit 04.

A web of material 68, coming from below, is fed from the exterior between the lower forme cylinder 14 and the counter-pressure cylinder 21 to the counter pressure cylinder 21 of the lower right "W" printing unit 08. This web of material 68 is looped around the counter-pressure cylinder 21 over approximately 180° and is removed toward the outside out of the lower right "W" printing unit 08 between the upper forme cylinder 13 and the counter-pressure cylinder 21. This web of material 68, which is fed over guide rollers 63 from the outside between the lower forme cylinder 14 and the counter-pressure cylinder 21 can then be directed to the counter-pressure cylinder 21 of the left upper "W" printing unit 03, where it is looped around cylinder 21 of unit 03 over approximately 180° and is removed toward the exterior between the upper forme cylinder 13 and the counter-pressure cylinder 21 out of the upper left "W" printing unit 03.

In the course of this, a first side of the web of material 68 is printed in two colors in the lower right "W" printing unit 08, and a second side of the web of material is printed in two colors in the upper left "W" printing unit 03.

A further web of material 69 is printed correspondingly to the first web of material 67 in a nine cylinder printing unit consisting of the upper right "V" and "W" printing units 02, 01, and in the lower right "V" printing unit 09. In the course of this, a first side of the web of material 69 is printed in two colors in the lower right "V" printing unit 09. Subsequently, a second side of the web of material 69 is printed in four colors in the upper nine cylinder printing unit.

The "V" and "W" printing units 01 to 04, 06 to 09, can be used as imprinters, i.e. while at least one pair of forme and transfer cylinders are placed against the counter-pressure cylinder for printing a web of material, at least one forme cylinder can be moved away for set-up purposes.

The printing units 01 to 04, 06 to 09 in modular construction are arranged in a support device. This support device or consists, for example, of three transverse supports 82, 83, 84, as seen in FIGS. 3 and 4, and which are arranged spaced apart from each other one above the other by means of vertically extending supports 86. The printing units 01 to 04, 06 to 09 are fastened to this support device or frame. With printing units 01 to 04, and 06 to 09 arranged on top of each other, i.e. on two levels, the upper printing units 01 to 04 are fastened on a transverse support 83, 84 or a support 86 of the support device. This transverse support 83, 84 is arranged above the lower printing unit 06 to 09. The transverse supports 82 to 84 can be divided into individual segments.

While preferred embodiments of a printing unit in accordance with the present invention have been set forth fully and completely hereinabove, it will be apparent to one of skill in the art that various changes in, for example, the type of material web being printed on, the specific drive motors for the various cylinders and the like could be made without departing from the true spirit and scope of the present invention which is accordingly to be limited only by the following claims.

What is claimed is:

1. A printing unit of an offset printing press comprising:

at least four forme cylinders;

and at least four transfer cylinders; and at least first and second counter-pressure cylinders; said printing unit being selectively operable in a first type of production in which said at least four transfer cylinders are placed against a common one of said first and second counter-pressure cylinders and in a second type of production in which at least first and second of said at least four transfer cylinders are arranged to work with one of said at least first and second counter-pressure cylinders and at least a third of said at least four transfer cylinders is arranged to work with another of said at least first and second counter-pressure cylinders.

2. The printing unit of claim 1 wherein said printing unit consists of two five cylinder printing units.

3. The printing unit of claim 2 wherein said two five cylinder printing units are a "V" printing unit.

4. The printing unit of claim 3 wherein said "V" printing unit is arranged fixed in in place.

5. The printing unit of claim 2 wherein each of said five cylinder printing units includes a pair of spaced lateral frames.

6. The printing unit of claim 2 wherein said two five cylinder printing units can be moved in relation to each other.

7. The printing unit of claim 6 further including a work platform selectively arranged between said two five cylinder printing units.

8. The printing unit of claim 2 wherein at least a section of said printing unit is constructed of two types of modular units.

9. The printing unit of claim 1 further including a second printing unit associated with said printing unit, said printing unit and said second printing unit being arranged on top of each other.

10. The printing unit of claim 9 wherein said printing unit is arranged for printing a first side of a web of material in four colors and said second printing unit is arranged for printing a second side of the web of material in two colors.

11. The printing unit of claim 1 further including a five cylinder printing unit having lateral side frames, said five cylinder printing unit being associated with said printing unit.

12. The printing unit of claim 11 wherein said printing unit is arranged for printing a first side of a web of material in four colors and said five cylinder printing unit is arranged for printing a second side of the web of material in two colors.

13. The printing unit of claim 1 further including a second printing unit, said printing unit printing a first side of a web of material in four colors, said second printing unit printing a second side of the web of material in four colors.

* * * * *